US005575425A

United States Patent [19]

Yoshizu

[11] Patent Number: 5,575,425

[45] Date of Patent: Nov. 19, 1996

[54] FUEL INJECTION NOZZLE

[75] Inventor: Fumitsugu Yoshizu, Saitama-ken, Japan

[73] Assignee: Zexel Corporation, Tokyo, Japan

[21] Appl. No.: 500,786

[22] Filed: Jul. 11, 1995

[30] Foreign Application Priority Data

Jul. 21, 1994 [JP] Japan ..... 6-190888

[51] Int. Cl.[6] ..... F02M 47/00

[52] U.S. Cl. ..... 239/533.8

[58] Field of Search ..... 239/533.3–533.12

[56] References Cited

U.S. PATENT DOCUMENTS

| | | | |
|---|---|---|---|
| 4,840,310 | 6/1989 | Haider | 239/533.8 X |
| 4,903,896 | 2/1990 | Letsche et al. | 239/533.9 X |
| 4,934,599 | 6/1990 | Hasagawa | 239/533.8 X |

FOREIGN PATENT DOCUMENTS

| | | | |
|---|---|---|---|
| 142576 | 7/1951 | Australia | 239/533.8 |
| 2253186 | 10/1971 | Germany | 239/533.8 |
| 4-8310 | 3/1992 | Japan . | |
| 163396 | 3/1958 | Sweden | 239/533.3 |
| 2188366 | 9/1987 | United Kingdom | 239/533.8 |

*Primary Examiner*—Kevin Weldon
*Attorney, Agent, or Firm*—Fish & Richardson P.C.

[57] ABSTRACT

A dodge plunger, a nozzle spring and a needle valve are received in a main body in this order toward a distal end of the body. The dodge plunger is of a hollow construction and has a pressure intake chamber and a guide hole arranged in this order toward the needle valve. A central plunger is slidably received in the guide hole of the dodge plunger. One end of the central plunger is faced with the pressure intake chamber. The central plunger projects from the dodge plunger toward the needle valve and is received in the nozzle spring. After the pilot injection is started as a result of lifting of the needle valve, the dodge plunger is lifted. As a consequence, a fuel pressure is introduced into the pressure intake chamber via a secondary valve seat. The central plunger is biased by the received fuel pressure and urges the needle valve toward the main valve seat.

2 Claims, 2 Drawing Sheets

FUEL INJECTION NOZZLE

BACKGROUND OF THE INVENTION

This invention relates to a fuel injection nozzle for injecting a fuel in two stages; a pilot injection stage and a main injection stage.

In a general fuel injection nozzle, a needle valve and a nozzle spring are received in a hollow main body. The needle valve is urged by the nozzle spring and sat on a main valve seat, thereby closing an injection port. A supply passage is formed in the main body. A high pressure fuel is intermittently and cyclically fed to this supply passage from a fuel injection pump which is driven by an engine. Upon receipt of the fuel pressure, the needle valve is lifted against the nozzle spring and allows the injection port to open. As a consequence, the high pressure fuel is injected through the injection port. When the supply of the high pressure fuel is temporarily stopped, the nozzle valve is caused to sit on the main valve seat under the effect of the nozzle spring. This fuel injection nozzle injects the fuel only once every time the high pressure fuel is supplied.

Recently, in order to improve combustion efficiency, various types of fuel injection nozzles are developed, in which a fuel is injected in two stages; a pilot injection stage and a main injection stage. One type of such a fuel injection nozzle, as disclosed in Japanese Utility Model Publication No. Hei 4-8310, is additionally provided with a dodge plunger. The dodge plunger is received in the main body. A secondary valve seat is formed on a basal end portion of the main body. The secondary valve seat is in connection with the supply passage. The dodge plunger is slidable in an axial direction such that it can sit on the secondary valve seat and it can be lifted from the second valve seat. The nozzle spring is disposed between the needle valve and the dodge plunger and biases them in a direction away from each other.

Before the supply of the high pressure fuel, the needle valve is caused to sit on the main valve seat under the effect of the nozzle spring and the dodge plunger to sit on the secondary valve seat. In the sitting state, a pressure bearing area of the needle valve for receiving a fuel pressure is larger than a pressure bearing area of the dodge plunger for receiving a fuel pressure. For this reason, when the supplied fuel pressure is increased exceeding an initial valve-opening pressure, the needle valve is lifted so that the pilot injection is started and then, a little later, the dodge plunger is lifted. In the lifted state, the pressure bearing surface of the dodge plunger is larger than the pressure bearing area of the lifted needle valve. Accordingly, the biasing force to the dodge plunger caused by the fuel pressure becomes larger than the biasing force to the needle valve caused by the fuel pressure. As a consequence, the dodge plunger contacts the stopper, thereby reaching its full lift position. The nozzle spring is compressed to the extent that the dodge plunger is fully lifted. Therefore, the biasing force of the nozzle spring is correspondingly increased. The needle valve is biased toward the main valve seat and sat thereon by the nozzle spring with such an increased biasing force. In this way, the pilot injection is finished.

After the completion of pilot injection, the needle valve, which is still sitting on the main valve seat, is subjected to the effect of the nozzle spring which is further compressed to the extent of the fully-lifted portion of the dodge plunger. When the fuel pressure is further increased and exceeds the main valve-opening pressure, a lifting force caused by this fuel pressure becomes larger than the force of the nozzle spring to lift the needle valve. As a consequence, the main injection is started. During the time the main injection is undergoing, the dodge plunger is retained by the stopper and held in its lifted position.

When the supply of fuel for a single supply portion is finished and the fuel pressure is decreased, the needle valve having the smaller pressure-bearing surface is sat on the main valve seat and then the dodge plunger is sat on the secondary valve seat. By this, the main injection is finished.

In the above-mentioned conventional fuel injection nozzle, the fuel can be injected in two stages of a pilot injection stage and a main injection stage during the time the engine is revolving at a low speed. However, during the time the engine is revolving at a high speed, the pilot injection and main injection are performed almost in a consecutive manner and cannot be clearly separated. The present inventor analyzed the causes as follows.

As mentioned above, at one stage during the period of the pilot injection, when the dodge plunger is fully lifted by a force caused by the fuel pressure, the nozzle spring is further compressed to bias the needle valve so that the needle valve can sit on the main valve seat. At that time, a delay occurs between the time the dodge plunger is lifted and the time the needle valve is sat on the main valve seat. This delay occurs due to compressive deformation of the nozzle spring . When the engine revolves at a low speed, the increase rate of the fuel pressure is low. Therefore, the delay due to the compressive deformation of the nozzle spring does not become a big problem and the needle valve can sit on the main valve seat. However, the increase rate of the fuel pressure is high when the engine revolves at a high speed. Therefore, the force given to the needle valve caused by the fuel pressure is larger than the force given to the needle valve as the nozzle spring is compressed. As a consequence, the needle valve cannot sit on the main valve seat.

Also, when the engine is revolving at a high speed, the needle valve is unable to keep sitting thereon for a long time but obliged to be lifted almost instantaneously (i.e., in a very short time) from the main valve seat, even if the needle valve is once successfully sat on the main valve seat. The reason is as follows. Since the main valve-opening pressure is determined by a biasing force of the nozzle spring at the time when the dodge plunger is lifted, it is constant irrespective of the number of revolution of the engine. When the engine is revolving at a high speed, the increase rate of the fuel pressure is high and rapidly reaches the main valve-opening pressure.

SUMMARY OF THE INVENTION

It is, therefore, an object of the present invention to provide a fuel injection nozzle in which the pilot injection and the main injection can be separated not only during the time the engine is revolving at a low speed but also during the time the engine is revolving at a high speed.

According to the present invention, there is provided a two-stage injection type fuel injection nozzle comprising:

(a) an elongated hollow main body, the main body having a first, a second and a third receiving hole connected to one another in this order from a distal end thereof to a basal end, the main body including an injection port and a main valve seat formed at the distal end thereof, the injection port being communicated with the first receiving hole through the main valve seat, the main body further including a supply passage formed in a wall thereof and extending in a longitudinal direction thereof, the supply passage being adapted to supply a high pressure fuel, one end of the supply passage being connected to the first receiving hole and the other end being opened at a basal end portion of the main body, the basal end portion of the main body being provided with a secondary valve seat adapted to intercommunicate the supply passage and the third receiving hole;

(b) a needle valve received in the first receiving hole of the main body, the needle valve being capable of sliding axially of the main body, the needle valve being sat on the main valve seat and lifted from the main valve seat;

(c) a dodge plunger received in the third receiving hole of the main body, the dodge plunger being capable of sliding axially of the main body, the dodge plunger being sat on the secondary valve seat and lifted from the secondary valve seat, a full lift position of the dodge plunger being determined by being contacted with a stopper formed on the main body;

(d) a nozzle spring received in a second receiving hole of the main body, the nozzle spring being disposed between the needle valve and the dodge plunger and adapted to bias the needle valve and dodge plunger in opposite directions, i.e., toward the main valve seat and secondary valve seat, respectively;

(e) a fuel-pressure bearing area of the needle valve in the sitting state being larger than a fuel-pressure bearing area of the dodge plunger in the sitting state, a fuel-pressure bearing area of the needle valve in the lifted state being smaller than a fuel-pressure bearing area of the dodge plunger in the lifted state, owing to the foregoing arrangement, lifting of the needle valve, lifting of the dodge plunger, sitting of the needle valve, re-lifting of the needle valve, re-sitting of the needle valve and sitting of the dodge plunger being made in a sequence every time the high pressure fuel is supplied via the supply passage, a pilot injection of the fuel being performed through the injection port during the time period from the time of first lifting of the needle valve to the time of sitting thereof, a main injection of the fuel being performed through the injection port during the time period from the time of re-lifting of the needle valve to the time of re-sitting thereof;

(f) the dodge plunger being of a hollow construction, the dodge plunger including a pressure intake chamber and a guide hole arranged in this order toward the needle valve, the guide hole being allowed to extend in an axial direction of the dodge plunger; and (g) a central plunger axially slidably received in the guide hole of the dodge plunger, one end of the central plunger being faced with the pressure intake chamber, the central plunger being allowed to project from the dodge plunger toward the needle valve and being inserted in the nozzle spring, the fuel pressure being introduced into the pressure intake chamber via the secondary valve seat by lifting the dodge plunger when the pilot injection is made, the central plunger being biased by the received fuel pressure to urge the needle valve toward the main valve seat.

DETAILED DESCRIPTION OF THE EMBODIMENT

One embodiment of the present invention will now be described with reference to FIGS. 1 to 3.

Figure 1:
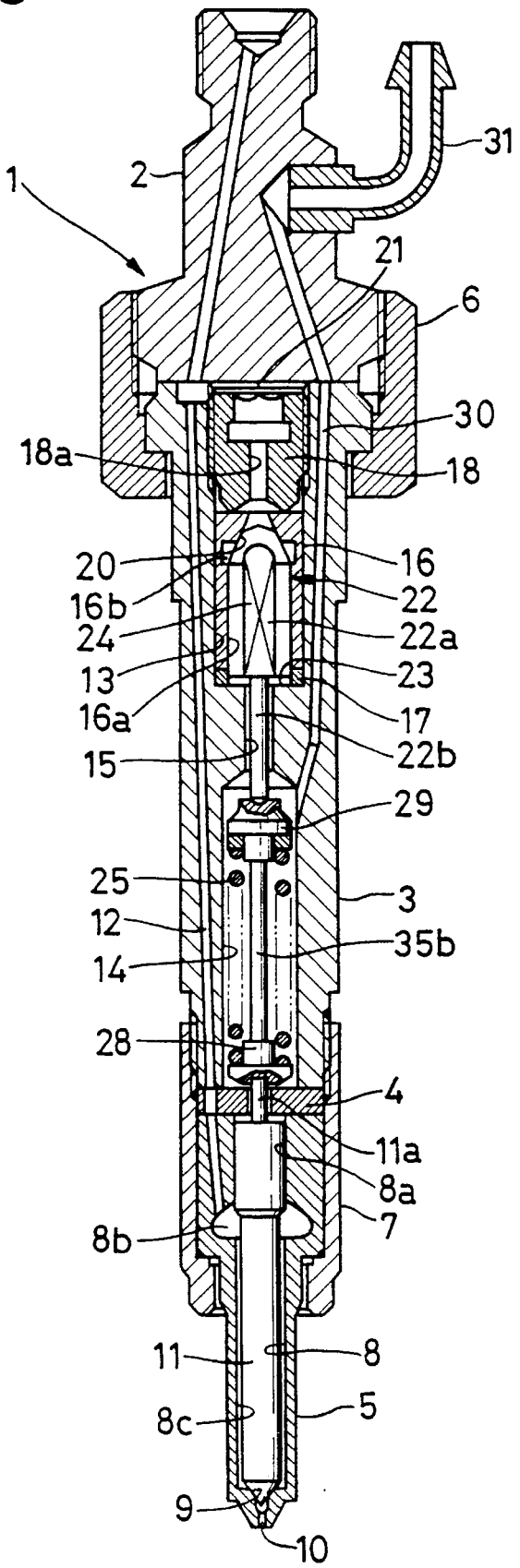
FIG. 1 is a vertical cross sectional view showing a fuel injection nozzle according to one embodiment of the present invention.

A fuel injection nozzle shown in FIG. 1 is mounted on an engine in such a manner as to face a combustion chamber of the engine. This fuel injection nozzle includes an elongated hollow main body 1. This main body 1 includes a plug 2, a nozzle holder 3, a spacer 4, and a nozzle body 5 all arranged in order from an upper end (basal end) toward a lower end (distal end) thereof. The plug 2 and the nozzle holder 3 are connected to each other by a nut 6. The nozzle body 5 is connected to the nozzle holder 3 by another nut 7.

A receiving hole 8 (first receiving hole) is formed in the nozzle body 5 and extends axially of the nozzle body 5. The receiving hole 8 has a guide portion 8*a*, a fuel pool portion 8*b* and a flow portion 8*c* all arranged in order from the top toward the bottom. A main valve seat 9 and an injection port 10 are formed at a distal end of the nozzle body 5. This nozzle port 10 is communicated with the receiving hole 8 through the main valve seat 9.

A needle valve 11 is received in the receiving hole 8. An upper end portion of the needle valve 11 is enlarged in diameter. This enlarged upper end portion is axially slidably received in the guide portion 8*a*. A lower end portion of the needle valve 11 is of a conical shape. This conical lower end portion is faced with the main valve seat 9. When the needle valve 11 is sat on the main valve seat 9, the injection port 11 is closed, and when the needle valve 11 is lifted from the main valve seat 9, the injection port 10 is opened. A full-lift position of the needle valve 11 is determined by the needle valve 11 contacting the spacer 4 (stopper).

A supply passage 12 for supplying the high pressure fuel is formed in the main body 1 over the entirety of the plug 2, nozzle holder 3, spacer 4 and nozzle body 5. One end of the supply passage 12 is open to an upper end face of the plug 2 and connected to fuel injection pump through a pipe. The other end of the supply passage 12 is connected to the fuel pool portion 8*b* of the receiving hole 8. The fuel injection pump is driven by the engine to feed the high pressure fuel cyclically and intermittently to the supply passage 12.

A receiving hole 13 is formed in an upper portion of the nozzle holder 3, and another receiving hole 14 (second receiving hole) is formed in a lower portion thereof. The receiving holes 13 and 14 extend axially of the nozzle holder 3. The receiving holes 13 and 14 are in communication with each other through a through-hole 15 having a reduced diameter. A cylinder 16 is received in a lower portion of the receiving hole 13 through a shim 17. This cylinder 16 is fixed by a screw member 18 screwed into an upper portion of the receiving hole 13. The cylinder 16 and screw member 18 constitute a part of the main body 1. An internal space of the cylinder 16 includes a guide hole 16*a* (third receiving hole) and a communication space 16*b* leading upwardly from an upper part of the guide hole 16*a*. A secondary valve seat 20 is formed on an upper end portion of the cylinder 16.

This secondary valve seat 20 is faced with the communication space 16*b*. The secondary valve seat 20 is communicated with the supply passage 12 through a communication hole 18*a* formed in the screw member 18 and a space 21 formed between the screw member 18 and the plug 2.

A dodge plunger 22 is inserted into the guide hole 16*a*. This dodge plunger 22 is axially slidable so that it can sit on the secondary valve seat 20 and it can be lifted from the secondary valve seat 20. The dodge plunger 22 is determined the full lift position by being brought into contact with an annular step 23 (stopper) which is formed on the boundary between the receiving hole 13 and the through-hole 15. A beveling 22*a* is formed on the dodge plunger 22. A leak passage 24 having a small sectional area is formed between the beveling 22*a* and an inner peripheral surface of the guide hole 16*a* of the cylinder 16.

A nozzle spring 25 is received in the receiving hole 14 of the nozzle holder 3. The needle valve 11 and the dodge plunger 22 are biased in a direction away from each other by the nozzle spring 25. Specifically, a rod portion 11*a* having a small diameter passes through the stopper 4 and extends axially upwardly from an upper end of the needle valve 11. An upper end of the rod portion 11*a* is disposed at a lower portion of the receiving hole 14. A rod portion 22*b* passes through the through-hole 15 and extends axially downwardly from a lower end of the dodge plunger 22. A lower end of the rod portion 11*b* is disposed at an upper portion of the receiving hole 14. The nozzle spring 25 biases the needle valve 11 toward the main valve seat 9 through a spring retainer 28 and the rod portion 11*a*. Also, the nozzle spring 25 biases the dodge plunger 22 toward the secondary valve seat 20 through a spring retainer 29 and the rod portion 22*b*.

The main body 1 has a drain passage 30 extending over the entirety of the plug 2 and nozzle holder 3. One end of the drain passage 30 is opened at the plug 2 and connected to a fuel tank through a pipe. The other end of the drain passage 30 is open to the receiving hole 14 in which the nozzle spring 25 is received.

The pressure-bearing areas of the needle valve 11 and dodge plunger 22 for receiving the fuel pressure will now be described. If the pressure-bearing areas at the time when the needle valve 11 is in the sitting state and when the needle valve 11 is in the lifted state are represented by $S_{N1}$ and $S_{N2}$, respectively, and similarly, if the pressure-bearing areas at the time when the dodge plunger 22 is in the sitting state and when the dodge plunger 22 is in the lifted state are represented by $S_{D1}$ and $S_{D2}$, respectively, the following expression is established.

$$S_{D1}<S_{N1}<S_{N2}<S_{D2} \quad ①$$

The pressure-bearing area $S_{N1}$ of the needle valve 11 when the needle valve 11 is in the sitting state, can be obtained by subtracting an area surrounded by a circular abutting line between the needle valve 11 and the main valve seat 9 from the sectional area of the upper end portion of the needle valve 11. The pressure-bearing area $S_{N2}$ when the needle valve 11 is in the lifted state, is equal to the sectional area of the upper end portion of the needle valve 11.

The pressure-bearing area $S_{D1}$ when the dodge plunger 22 is in the sitting state is equal to an area surrounded by a circular abutting line between the dodge plunger 22 and the secondary valve seat 20. The pressure-bearing area $S_{D2}$ when the dodge plunger 22 is in the lifted state, is obtained by subtracting a sectional area of a head portion 35*a* of a central plunger 35 as later described from a sectional area of the dodge plunger 22.

Figure 2:
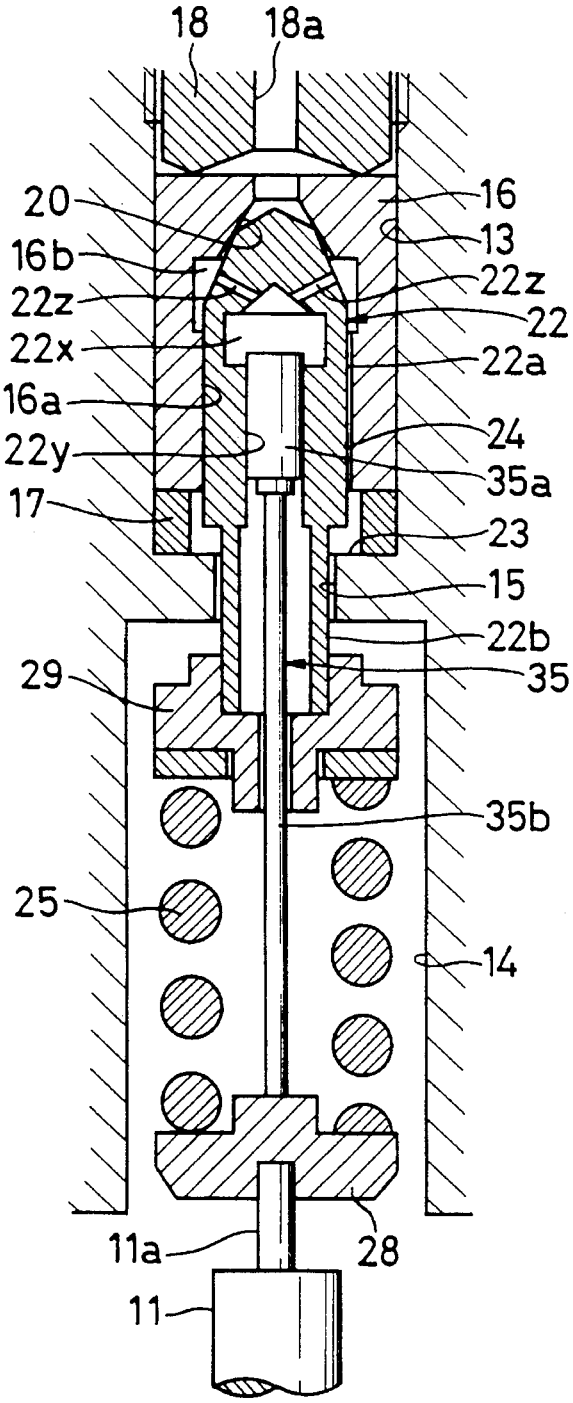
FIG. 2 is an enlarged sectional view showing an important portion of the fuel injection nozzle, in which both a needle valve and a dodge plunger are in their sitting states, respectively. The section of FIG. 2 intersects that of FIG. 1 at 90 degrees.
Figure 3:
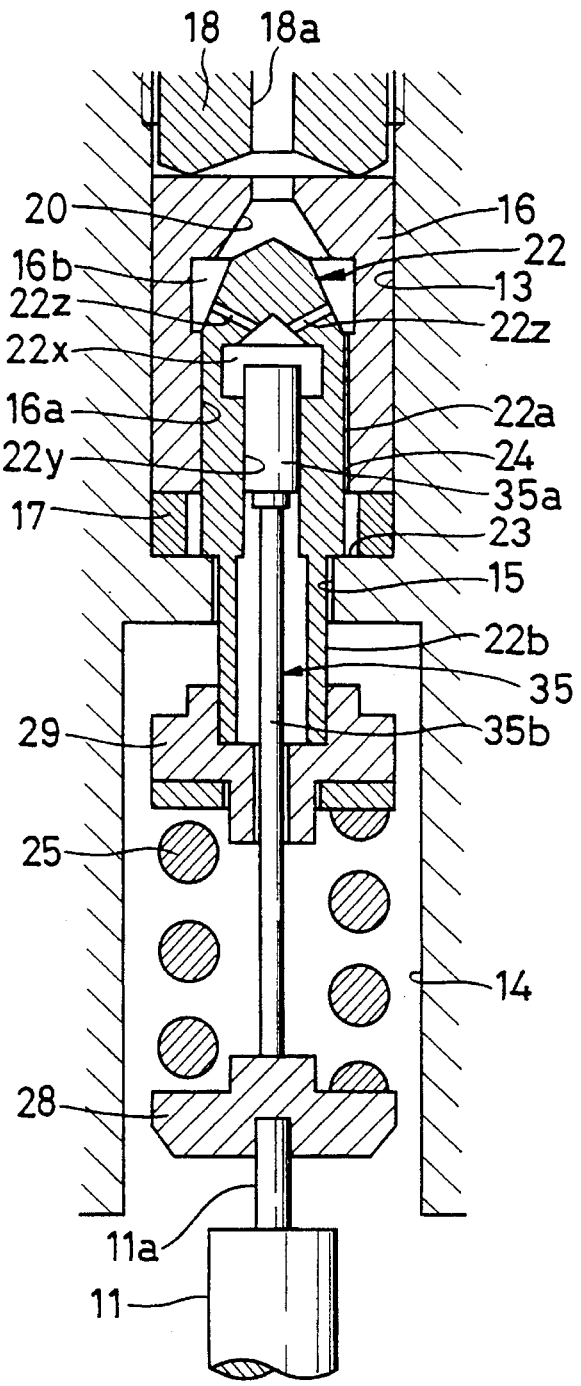
FIG. 3 is a view like FIG. 2, but in which the needle valve and the dodge plunger are in their lifted positions, respectively.

As shown in FIGS. 2 and 3, the features of the present invention are that the dodge plunger 22 is of a hollow construction and the central plunger 35 is received therein. Specifically, an upper portion of an internal space of the dodge plunger 22 is defined as a pressure intake chamber 22*x*, and an intermediate portion thereof is defined as a guide hole 22*y*. A lower end of the internal space of the dodge plunger 22 is open to a lower end face of the dodge plunger 22. The pressure intake chamber 22*x* is communicated with the communication space 16*b* through a through-hole 22*z* formed in the upper end portion of the dodge plunger 22. The central plunger 35 has the head portion 35*a* of the upper end portion and a rod portion 35*b* extending axially downwardly from the head portion 35*a*. The head portion 35*a* is slidably received in the guide hole 22*y* of the dodge plunger 22, whereas the rod portion 35*b* projects downwardly from the dodge plunger 22, and extends through the spring retainer 29 and further through the nozzle spring 25. A lower end of the rod portion 35*b* is caused to abut against the spring retainer 28 by gravity and fuel pressure.

With the above-mentioned construction, before the fuel is fed, under pressure, from the fuel injection pump to the fuel injection nozzle, the needle valve 11 is sat on the main valve seat 9 and the dodge plunger 22 is sat on the secondary valve seat 20 by the force of the nozzle spring 25. When the pressure of the fuel fed under pressure exceeds a predetermined initial valve-opening pressure $P_{NI}$ which is regulated by the nozzle spring 25, the needle valve 11 is lifted from the main valve seat 9 and the fuel is injected through the injection port 10. That is, the pilot injection is started. Here, the initial valve-opening pressure $P_{NI}$ can be expressed by the following expression.

$$P_{NI}=F_1/S_{N1} \quad ②$$

where $F_1$ denotes a force exerted to the needle valve 11 by the nozzle spring 25 during the time both the needle valve 11 and dodge plunger 22 are in their sitting states.

When the needle valve 11 is lifted, the central plunger 35 is moved upwardly in response to the movement of the needle valve 11. Then, the fuel in the pressure intake chamber 22*x* is pushed by the central plunger 35 and fed to the drain passage 30 via the communication space 16*b* and leak passage 24. At that time, since the leak passage 24 undertakes a role of an orifice, the speed of movement of the central plunger 35 is restricted to low. As a consequence, the speed of lifting of the needle valve 11 can be restricted to low.

When the fuel pressure is further increased to exceed the lift pressure $P_{DL}$ at the full lift position where the needle valve 11 is in contact with the spacer 4, the dodge plunger 22 is lifted. Here, the lift pressure $P_{DL}$ can be expressed by the following expression.

$$P_{DL}=F_2/S_{D1} \quad ③$$

where $F_2$ denotes a force exerted to the dodge plunger 22 by the nozzle spring 25 during the time the needle valve 11 is in its lifted state and the dodge plunger 22 is in its sitting state.

When the lifting of the dodge plunger 22 is started, the pressure-bearing surface of the dodge plunger 22 is abruptly increased from $S_{D1}$ to $S_{D2}$. Consequently, the dodge plunger 22 is moved quickly downwardly until it contacts the step 23, thus reaching the full lift position. As a consequence, the leak passage 24 is closed.

The nozzle spring 25 is further compressed by lifting the dodge plunger 22 to the full lift position. Therefore, the biasing force of the nozzle spring 25 applied to the needle valve 11 is increased. By lifting the dodge plunger 22, the high pressure fuel is introduced into the communication space 16*b*. This fuel pressure is introduced into the pressure intake chamber 22*x* via the communication hole 22*z*. By this fuel pressure, the central plunger 35 is biased downwardly to push the needle valve 11 toward the main valve seat 9 through the spring retainer 28.

As mentioned above, the force exerted to the needle valve 11 by the nozzle spring 25 is increased and the pressing force is applied to the needle valve 11 by the central plunger 35, thereby the needle valve 11 is caused to sit on the main valve seat 9 and the pilot injection is finished. In the above-mentioned prior art in which the needle valve 11 is caused to sit depending merely on increase of the biasing force of the nozzle spring 25, since the increase rate of the fuel pressure is high when the engine is revolving at a high speed, the downward movement of the needle valve 11 is delayed and the needle valve 11 cannot sit. According to the teaching of the present invention, however, since the central plunger 35 pushes the needle valve 11 with a force caused by the fuel pressure, a possible delay of transmission of a force due to compressive deformation of the nozzle spring 25 can be compensated even during the time the engine is revolving at a high speed. Thus, the needle valve 11 can be sat positively. Therefore, the pilot injection and a main injection as later described can be separated.

In the state where the dodge plunger 22 is in its full lift position and the needle valve 11 is sitting on the main valve seat 9, the force $F_3$ of the nozzle spring 25 and the pressing force from the central plunger 35 caused by the fuel pressure act on the needle valve 11. The pressing force is obtained by means of multiplication of the pressure-bearing area $S_C$ of the central plunger 35 by the fuel pressure. When the fuel pressure is further increased and exceeds the main valve-opening pressure $P_M$, the needle valve 11 is lifted from the main valve seat 9 and the main injection is started. Here, the main valve-opening pressure $P_M$ can be expressed by the following expression.

$$P_M=F_3/(S_{N1}-S_C) \quad ④$$

The pressure-bearing area $S_C$ of the central plunger 35 is equal to the sectional area of the head portion 35*a* of the central plunger 35 and smaller than the pressure-bearing area $S_{N1}$ of the needle valve 11 when the needle valve 11 is sat. In the above expression ④, the transmission time of the fuel pressure is disregarded and it is presumed that the fuel pressure applied to the central plunger 35 and the fuel pressure applied to the needle valve 10 are equal to each other, for the sake of simplicity.

As apparent from the above expression ④, since the central plunger 35 pushes the needle valve 11 upon receipt of the fuel pressure, the main valve-opening pressure $P_M$ is higher than the main valve-opening pressure $P_M'$ of the conventional fuel injection nozzle (see the following expression ⑤).

$$P_M'=F_3/S_{N1} \quad ⑤$$

As a consequence, the main injection can be more delayed and the pilot injection and main injection can be more clearly separated when compared with the conventional device.

When the supply of the high pressure fuel for a single supply portion is finished after the needle valve 11 has been lifted, the fuel pressure is lowered. As a consequence, the needle valve 11 is moved toward the main valve seat 9 under the effect of the nozzle spring 25 first. At that time, the central plunger 35 is moved downwardly by the fuel pressure in the pressure intake chamber 22*x* while keeping its contact with the spring retainer 28 on the side of the needle valve 11. When the needle valve 11 is sat on the main valve seat 9, the main injection is finished. After the needle valve 11 is sat on the main valve seat 9, the dodge plunger 35 is biased upwardly by the nozzle spring 25 and sat on the secondary valve seat 20.

With the dodge plunger 22 sitting on the secondary seat 20, the fuel in the communication space 16*b* escapes to the drain passage 30 via the leak passage 24, so that the high pressure is prevented from being confined in the communication space 16*b*.

The present invention is not limited to the above-mentioned embodiment and many changes can be made. For example, if it is preferred that the speed of lifting of the needle valve is not restricted when the pilot injection is made, a downward movement of the central plunger may be restricted by a stopper or the central plunger may be biased upwardly by a spring having a small resilient force, so that the central plunger is kept away a predetermined distance from the spring retainer on the side of the needle valve with the needle valve and dodge plunger sitting on the respective valve seats.

What is claimed is:

1. A two-stage injection type fuel injection nozzle comprising:

(a) an elongated hollow main body, said main body having a first, a second and a third receiving hole connected to one another in this order from a distal end thereof to a basal end, said main body including an injection port and a main valve seat formed at the distal end thereof, said injection port being communicated with said first receiving hole through said main valve seat, said main body further including a supply passage formed in a wall thereof and extending in a longitudinal direction thereof, said supply passage being adapted to supply a high pressure fuel, one end of said supply passage being connected to said first receiving hole and the other end being opened at a basal end portion of said main body, the basal end portion of said main body being provided with a secondary valve seat adapted to intercommunicate said supply passage and said third receiving hole;

(b) a needle valve received in said first receiving hole of said main body, said needle valve being capable of sliding axially of said main body, said needle valve being sat on said main valve seat and lifted from said main valve seat;

(c) a dodge plunger received in said third receiving hole of said main body, said dodge plunger being capable of sliding axially of said main body, said dodge plunger being sat on said secondary valve seat and lifted from said secondary valve seat, a full lift position of said dodge plunger being determined by being contacted with a stopper formed on said main body;

(d) a nozzle spring received in a second receiving hole of said main body, said nozzle spring being disposed between said needle valve and said dodge plunger and adapted to bias said needle valve and dodge plunger in opposite directions, i.e., toward said main valve seat and secondary valve seat, respectively;

(e) a fuel-pressure bearing area of said needle valve in the sitting state being larger than a fuel-pressure bearing area of said dodge plunger in the sitting state, a fuel-pressure bearing area of said needle valve in the lifted state being smaller than a fuel-pressure bearing area of said dodge plunger in the lifted state, owing to the foregoing arrangement, lifting of said needle valve, lifting of said dodge plunger, sitting of said needle valve, re-lifting of said needle valve, re-sitting of said needle valve and sitting of said dodge plunger being made in a sequence every time the high pressure fuel is supplied via said supply passage, a pilot injection of the fuel being performed through said injection port during the time period from the time of first lifting of said needle valve to the time of sitting thereof, a main injection of the fuel being performed through said injection port during the time period from the time of re-lifting of said needle valve to the time of re-sitting thereof;

(f) said dodge plunger being of a hollow construction, said dodge plunger including a pressure intake chamber and a guide hole arranged in this order toward said needle valve, said guide hole being allowed to extend in an axial direction of said dodge plunger; and (g) a central plunger axially slidably received in said guide hole of said dodge plunger, one end of said central plunger being faced with said pressure intake chamber, said central plunger being allowed to project from said dodge plunger toward said needle valve and being inserted in said nozzle spring, the fuel pressure being introduced into said pressure intake chamber via said secondary valve seat by lifting said dodge plunger when the pilot injection is made, said central plunger being biased by the received fuel pressure to urge said needle valve toward said main valve seat.

2. A fuel injection nozzle according to claim 1, in which a leak passage having a small flow sectional area is formed between said dodge plunger and an inner peripheral surface of said third receiving hole, said leak passage being in communication with a drain passage which is formed in said main body, when said dodge plunger is lifted to contact said stopper, the communication between said leak passage and said drain passage being cut off by said stopper, when said needle valve is lifted, with said dodge plunger being held in a sitting position thereof, said needle valve urging said central plunger to move, the fuel in said pressure intake chamber of said dodge plunger being discharged to said drain passage via said leak passage in accordance with the movement of said central plunger.

* * * * *